US007909524B2

(12) United States Patent
Connors et al.

(10) Patent No.: US 7,909,524 B2
(45) Date of Patent: Mar. 22, 2011

(54) FOLDING EDGE GUIDE ASSEMBLY FOR AN IMAGING APPARATUS

(75) Inventors: William M. Connors, Lexington, KY (US); Walter K. Cousins, Lexington, KY (US); Daniel R. Gagnon, Harrodsburg, KY (US); Kris E. Kallenberger, Lexington, KY (US); Kevin J. Maudsley, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 199 days.

(21) Appl. No.: 11/171,626

(22) Filed: Jun. 30, 2005

(65) Prior Publication Data

US 2007/0003355 A1 Jan. 4, 2007

(51) Int. Cl.
*B41J 13/26* (2006.01)

(52) U.S. Cl. ..... 400/630; 400/633; 400/632.1; 400/642; 271/226; 271/248; 271/249

(58) Field of Classification Search ..... 400/624, 400/630, 631, 632.1, 633, 642, 633.1, 691, 400/692, 693; 271/127, 171, 223, 3.02, 240, 271/248, 250, 253, 162, 169, 226; 347/104
See application file for complete search history.

(56) References Cited

U.S. PATENT DOCUMENTS

| | | | | | |
|---|---|---|---|---|---|
| 4,714,243 | A * | 12/1987 | Staniszewski | ..... | 271/171 |
| 4,729,683 | A * | 3/1988 | Staniszewski | ..... | 400/624 |
| 4,838,535 | A * | 6/1989 | Yokoi et al. | ..... | 271/22 |
| 5,054,759 | A * | 10/1991 | Lohrmann et al. | ..... | 271/22 |
| 5,651,623 | A * | 7/1997 | Stodder et al. | ..... | 400/605 |
| 5,918,873 | A * | 7/1999 | Saito et al. | ..... | 271/10.11 |
| 5,927,702 | A * | 7/1999 | Ishii et al. | ..... | 271/9.09 |
| 5,971,390 | A * | 10/1999 | Caspar et al. | ..... | 271/121 |
| 5,984,300 | A * | 11/1999 | Nishiberi | ..... | 271/171 |
| 6,428,000 | B1 * | 8/2002 | Hara et al. | ..... | 271/223 |
| 6,469,811 | B1 * | 10/2002 | Tamura | ..... | 358/498 |
| 6,698,744 | B2 * | 3/2004 | Yamada et al. | ..... | 270/58.12 |
| 6,793,425 | B2 * | 9/2004 | Yoshikawa et al. | ..... | 400/624 |
| 6,859,638 | B2 * | 2/2005 | Nobe | ..... | 399/377 |

* cited by examiner

*Primary Examiner* — Leslie J Evanisko
*Assistant Examiner* — Matthew G Marini
(74) *Attorney, Agent, or Firm* — Taylor & Aust, PC

(57) ABSTRACT

A media edge guide assembly for use in an imaging apparatus having a media supply source includes a first edge guide portion and a second edge guide portion. The first edge guide portion and the second edge guide portion are arranged to have an axis of rotation passing through the first edge guide portion and the second edge guide portion. The first edge guide portion and the second edge guide portion are laterally interconnected to facilitate movement as a unit in a lateral direction along the axis of rotation, and the first edge guide portion and the second edge guide portion are configured to be rotationally disconnected with respect to the axis of rotation to permit the first edge guide portion to rotate around the axis of rotation independent of the second edge guide portion.

19 Claims, 5 Drawing Sheets

FOLDING EDGE GUIDE ASSEMBLY FOR AN IMAGING APPARATUS

BACKGROUND OF THE INVENTION

1. Field of the Invention

The present invention relates to an imaging apparatus, and, more particularly, to a folding edge guide assembly for an imaging apparatus.

2. Description of the Related Art

An imaging apparatus may be in the form of a printer, or a multifunction machine, also known as an all-in-one (AIO) machine, which includes scanning and copying capabilities in addition to printing.

The print engine of the printer or the AIO may include, for example, an ink jet print engine that typically forms an image on a sheet of print media by ejecting ink from at least one ink jet printhead to place ink dots on the sheet of print media. Such an ink jet print engine typically includes a reciprocating printhead carrier. Mounted to the carrier is one or more printhead cartridges, each including an ink supply and at least one printhead. The carrier transports the ink jet printheads across the sheet of print media along a bi-directional scanning path defining a print zone of the print engine. The bidirectional scanning path is oriented parallel to a main scan direction, also commonly referred to as the horizontal direction.

Typically, a sheet of print media is picked from a stack of print media supported in a media tray, and transported by a feed roller to the print zone for printing. An indexing mechanism drives the feed roller to incrementally advance the sheet of print media in a sheet feed direction, also commonly referred to as a sub-scan direction, through the print zone between scans in the main scan direction, or after all data intended to be printed on the sheet of print media at a particular stationary position has been completed.

Some imaging apparatus include a foldable media support. The foldable media support serves as an extension of a stationary base media support formed in the housing of the imaging apparatus. When the foldable media support is folded out to an operating position, a stack of print media may be accommodated. While it may be desirable to provide a media edge guide near to the middle of the stack height of the stack of print media, the location of the axis of rotation of the foldable media support has limited the placement of the media edge guide. In one such imaging apparatus utilizing such a configuration of the media support, for example, the media edge guide is mounted to the stationary base media support, and in turn, provides edge support only near the bottom of the stack of print media in the print media feed direction.

SUMMARY OF THE INVENTION

The invention, in one form thereof, is directed to a media edge guide assembly for use in an imaging apparatus having a media supply source. The media edge guide assembly includes a first edge guide portion and a second edge guide portion. The first edge guide portion and the second edge guide portion are arranged to have an axis of rotation passing through the first edge guide portion and the second edge guide portion. The first edge guide portion and the second edge guide portion are laterally interconnected to facilitate movement as a unit in a lateral direction along the axis of rotation, and the first edge guide portion and the second edge guide portion are configured to be rotationally disconnected with respect to the axis of rotation to permit the first edge guide portion to rotate around the axis of rotation independent of the second edge guide portion.

The invention, in another form thereof, is directed to an imaging apparatus including a media supply source for feeding a sheet of media in a media feed direction. The imaging apparatus includes a base including a stationary media support. A movable media support is pivotably connected to the base to pivot around an axis of rotation. The axis of rotation is substantially orthogonal to the media feed direction. The movable media support has a stowed position and an operating position, wherein when the movable media support is in the operating position, the stationary media support and the movable media support cooperate to hold a supply of print media. A first edge guide portion is mounted to the movable media support. The first edge guide portion is movable in a lateral direction along the axis of rotation. A second edge guide portion operates as an extension of the first edge guide portion. The first edge guide portion and the second edge guide portion are laterally interconnected to move as a unit in the lateral direction along the axis of rotation to adjust to a width of the supply of print media. In addition, the first edge guide portion and the second edge guide portion are configured to be rotationally disconnected with respect to the axis of rotation to permit the first edge guide portion to rotate around the axis of rotation in conjunction with the movable media support independent of the second edge guide portion.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate embodiments of the invention, and such exemplifications are not to be construed as limiting the scope of the invention in any manner.

DETAILED DESCRIPTION OF THE INVENTION

Figure 1:
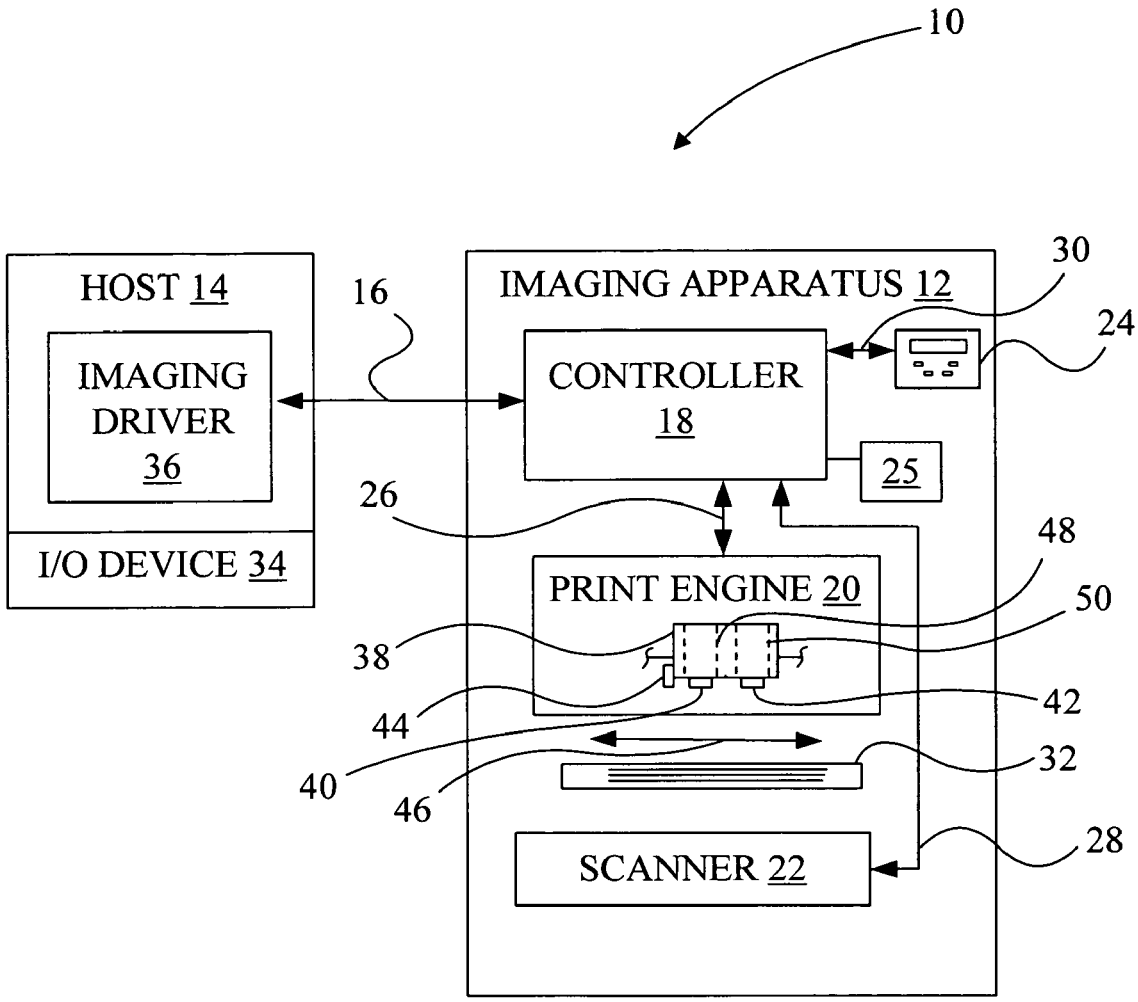
FIG. 1 is a diagrammatic depiction of a system embodying the present invention.

Referring now to the drawings and particularly to FIG. 1, there is shown a diagrammatic depiction of an imaging system 10. Imaging system 10 may include an imaging apparatus 12 and a host 14, with imaging apparatus 12 communicating with host 14 via a communications link 16.

Imaging apparatus 12 may be configured to communicate with host 14 via a standard communication protocol, such as for example, universal serial bus (USB) or Ethernet. As used herein, the term "communications link" is used to generally refer to structure that facilitates electronic communication between two components, and may operate using wired or wireless technology. Communications link 16 may be established, for example, by a direct cable connection, wireless connection or by a network connection such as for example an Ethernet local area network (LAN).

Alternatively, imaging apparatus 12 may be a standalone unit that is not communicatively linked to a host, such as host 14. For example, imaging apparatus 12 may take the form of a multifunction machine, e.g., an all-in-one (AIO) device, which includes standalone copying and facsimile capabilities, in addition to optionally serving as a printer when attached to a host, such as host 14. Imaging apparatus 12 includes, for example, a controller 18, a print engine 20, a scanner 22 and a user interface 24.

Controller 18 includes a processor unit and associated memory, such as memory 25, and may be formed as an Application Specific Integrated Circuit (ASIC). Controller 18 communicates with print engine 20 via a communications link 26. Controller 18 communicates with scanner 22 via a communications link 28. Controller 18 communicates with user interface 24 via a communications link 30. Communications links 26, 28 and 30 may be established, for example, by using standard electrical cabling or bus structures, or by wireless connection.

In the context of the examples for imaging apparatus 12 given above, print engine 20 may be, for example, an ink jet print engine configured for forming an image on a sheet of print media 32, such as a sheet of paper, transparency or fabric. As an ink jet print engine, for example, print engine 20 operates one or more printing cartridges and/or printheads to eject ink droplets onto the sheet of print media 32 in order to reproduce text and/or images.

Host 14 may be, for example, a personal computer including an input/output (I/O) device 34, such as a keyboard and display monitor. Host 14 further includes a processor, input/output (I/O) interfaces, memory, such as RAM, ROM, NVRAM, and a mass data storage device, such as a hard drive, CD-ROM and/or DVD units. During operation, host 14 includes in its memory a software program including program instructions that function as an imaging driver 36, e.g., printer driver software for imaging apparatus 12. Imaging driver 36 is in communication with controller 18 of imaging apparatus 12 via communications link 16. Imaging driver 36 facilitates communication between imaging apparatus 12 and host 14, and may provide formatted print data to imaging apparatus 12, and more particularly, to print engine 20.

Alternatively, however, all or a portion of imaging driver 36 may be located in controller 18 of imaging apparatus 12. For example, where imaging apparatus 12 is a multifunction machine having standalone capabilities, controller 18 of imaging apparatus 12 may include an imaging driver configured to support a scanning and/or copying function using scanner 22, and/or a fax-print function, and may be further configured to support a printer function. Scanner 22 may be, for example, a bed type scanner with a movable scan bar, or a scanner that transports paper under a stationary scan bar. In one embodiment, for example, the imaging driver facilitates communication of formatted print data, as determined by a selected print mode, to print engine 20, and facilitates communication of scanned image data to controller 18.

Print engine 20 may include, for example, a reciprocating printhead carrier 38, a color ink jet printhead 40, a monochrome ink jet printhead 42 and (optionally) a reflectance sensor 44. Controller 18 serves to process print data and to operate print engine 20 during printing, as well as to operate scanner 22, process image data obtained via scanner 22, and process printhead alignment data obtained by scanner 22 or reflectance sensor 44. In order for print data from host 14 to be properly printed by print engine 20, the RGB data generated by host 14 is converted into data compatible with print engine 20 and ink jet printheads 40, 42. Likewise, in order for scanner data from scanner 22 to be properly printed by print engine 20, the RGB data generated by scanner 22 is converted into data compatible with print engine 20 and ink jet printheads 40, 42.

Printhead carrier 38 transports ink jet printheads 40, 42 and reflectance sensor 44 in a reciprocation manner along a bidirectional main scan path 46 over an image surface of the sheet of print media 32 during printing and/or sensing operations. Printhead carrier 38 may be mechanically and electrically configured to mount, carry and facilitate one or more of each of a color printhead cartridge 48 and a monochrome printhead cartridge 50. Each color printhead cartridge 48 may include, for example, an ink reservoir containing a supply of ink, to which at least one respective color ink jet printhead 40 is attached. Each monochrome printhead cartridge 50 may include, for example, an ink reservoir containing a supply of ink, to which at least one respective monochrome ink jet printhead 42 is attached. Alternatively, monochrome ink jet printhead 42 may be replaced by another color printhead, such as a photo printhead for jetting diluted color and mono inks.

Figure 2:
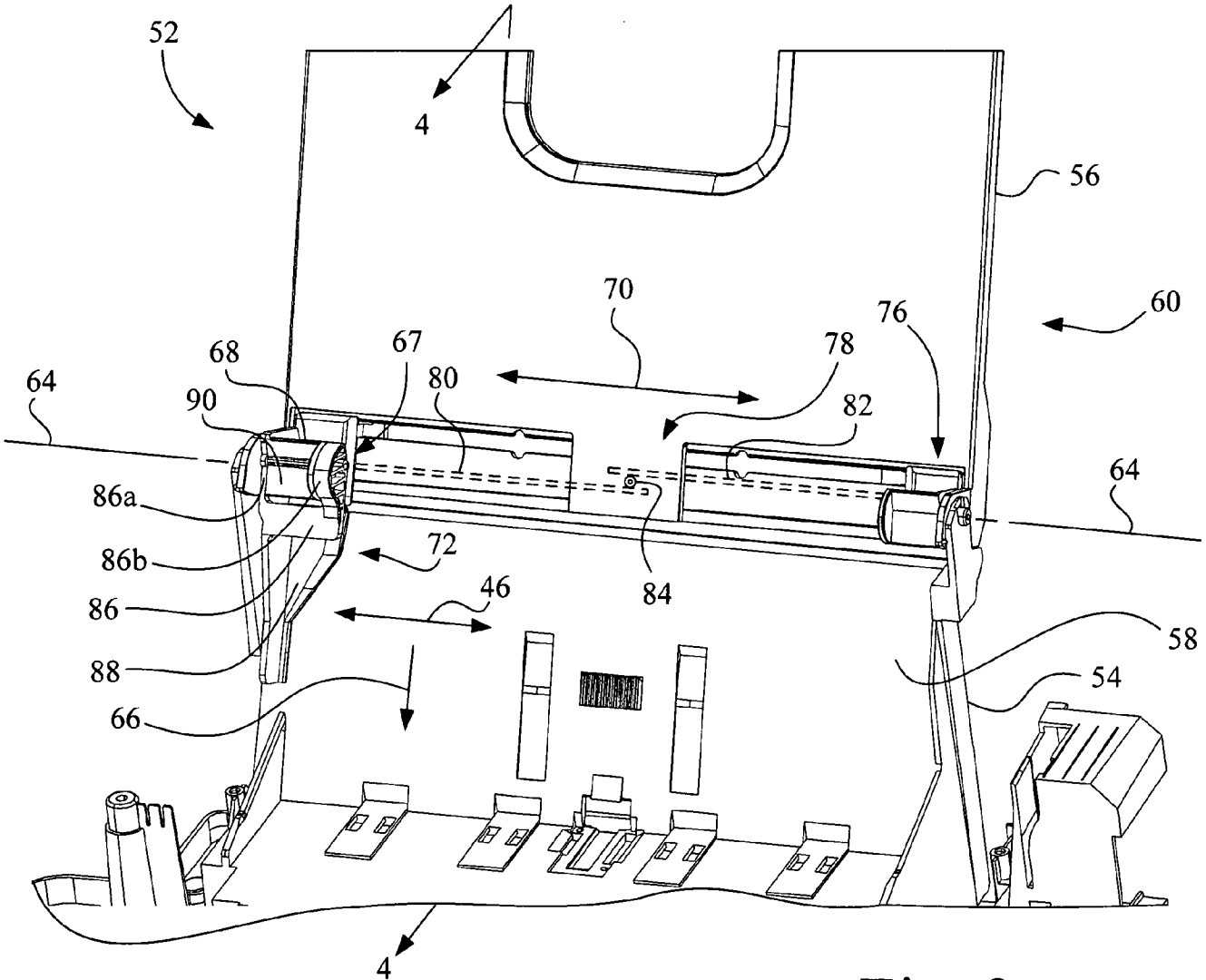
FIG. 2 is a perspective view of a media supply source of the imaging apparatus of FIG. 1 including a base having a stationary media support, and with a movable media support positioned in an operating position.
Figure 3:
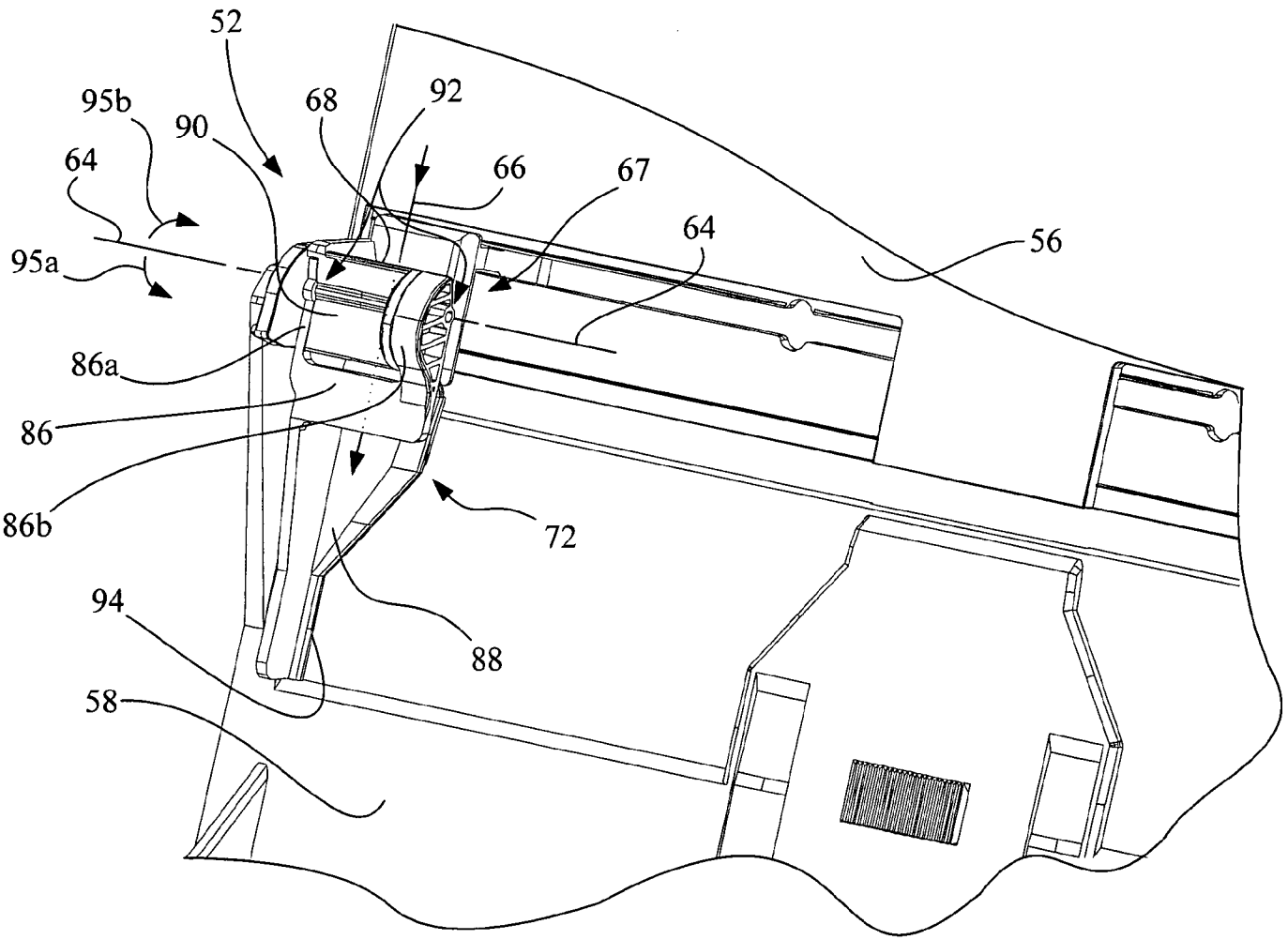
FIG. 3 is an enlarged portion of the media supply source of FIG. 2.
Figure 4:
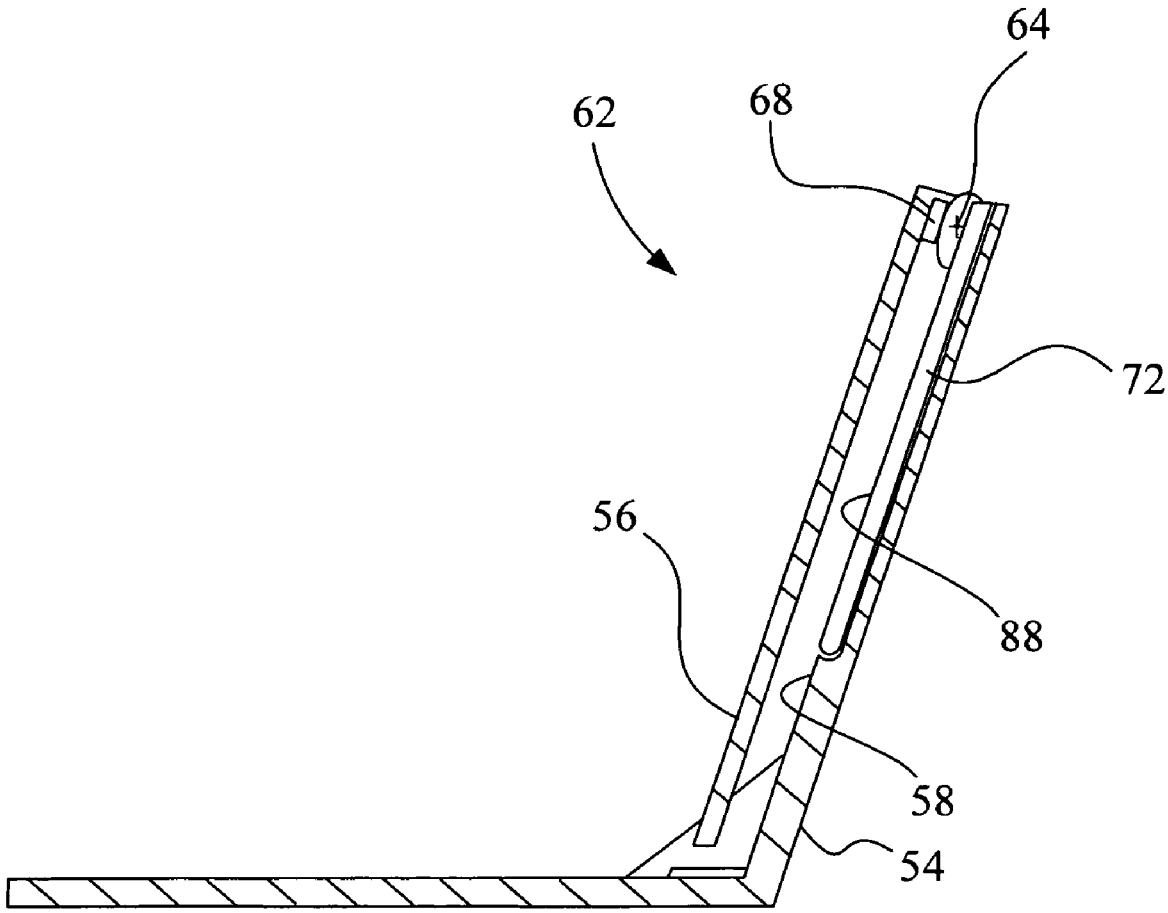
FIG. 4 is a diagrammatic side sectional view of the media supply source of FIG. 2 with the movable media support positioned in a stowed position.

Referring now to FIGS. 2-4, imaging apparatus 12 includes a media supply source 52 formed by a base 54 and a movable media support 56. In the present embodiment, base 54 includes a stationary media support 58, and may provide, in part, a housing that contains print engine 20 and scanner 22. When movable media support 56 is in an operating position 60, as shown in FIG. 2, movable media support 56 and stationary media support 58 combine to provide support a stack of print media (not shown), from which a sheet of print media 32 may be picked and fed to print engine 20 during a printing operation. FIG. 3 is an enlarged portion of the media supply source 52 of FIG. 2. FIG. 4 is an exemplary diagrammatic side view of the media supply source 52 of FIG. 2, showing movable media support 56 in a stowed position 62, i.e., in a folded position. Movable media support 56 is pivotably connected to base 54, such as by a pin and socket arrangement, to pivot around an axis of rotation 64. Axis of rotation 64 is parallel to bi-directional main scan path 46, and is substantially orthogonal to a media feed direction 66.

In the exemplary embodiment shown in FIG. 4, stowed position 62 is shown as a position wherein movable media support 56 has pivoted about 180 degrees from the operating position 60. However, those skilled in the art will recognize that the stowed position 62 may be located at other angular displacements of movable media support 56 from operating position 60, such as for example, when movable media support 56 is substantially horizontal. Accordingly, a hard stop may be provided within the pivot path of movable media support 56 to limit the amount of pivoting of movable media support 56 around axis of rotation 64.

A first media edge guide 67 includes a first edge guide portion 68 and a second edge guide portion 72. First edge guide portion 68 is mounted to movable media support 56. First edge guide portion 68 is movable in a lateral direction 70 along axis of rotation 64. Second edge guide portion 72 operates as an extension of first edge guide portion 68. First edge guide portion 68 and second edge guide portion 72 are laterally interconnected to move as a unit in lateral direction 70 along axis of rotation 64 to adjust to a width of the supply of print media. In addition, first edge guide portion 68 and second edge guide portion 72 are configured to be rotationally disconnected with respect to axis of rotation 64 to permit first edge guide portion 68 to rotate around axis of rotation 64 in conjunction with movable media support 56 independent of second edge guide portion 72.

In the embodiment shown in FIG. 2, first edge guide portion 68 and second edge guide portion 72 combine to form first media edge guide 67, located on the left side of media supply source 52, as shown. A second media edge guide 76 is laterally spaced apart from first media edge guide 67 along axis of rotation 64. Second media edge guide 76 may have a configuration that is a mirror image of first media edge guide 67, or, for example, may only include a portion corresponding to first edge guide portion 68.

Referring to FIG. 2, a rack gear system 78, including rack gear 80, rack gear 82 and pinion gear 84, couples first media edge guide 67 to second media edge guide 76. Rack gear system 78 is configured such that first media edge guide 67 and second media edge guide 76 move in unison in lateral direction 70 along axis of rotation 64, but in opposite directions.

In the exemplary embodiment shown, second edge guide portion 72 includes a substantially U-shaped member 86 and an elongate member 88 extending from U-shaped member 86. U-shaped member 86 is defined by a first arm 86*a* and a second arm 86*b*, wherein second arm 86*b* is spaced apart from first arm 86*a*. First edge guide portion 68 includes a body 90 received in U-shaped member 86 between first arm 86*a* and second arm 86*b*. As shown in FIG. 3, axis of rotation 64 passes through first arm 86*a* of second edge guide portion 72, body 90 of first edge guide portion 68, and second arm 86*b* of second edge guide portion 72. In the embodiment of FIGS. 2-4, elongate member 88 of second edge guide portion 72 engages stationary media support 58 of base 54 without connection thereto.

Alternatively, in other embodiments, second edge guide portion 72 may be designed to have another shape other than a U-shape, if desired. For example, second edge guide portion 72 may have a single arm, thereby having a substantially L-shape configuration.

In the present embodiment, referring to FIG. 3, a pivot mechanism 92, e.g., a pin and socket arrangement, pivotably connects second edge guide portion 72 to first edge guide portion 68. Pivot mechanism 92 is positioned such that first edge guide portion 68 pivots in relation to second edge guide portion 72 around axis of rotation 64. As such, stationary media support 58 provides a stop 94 to prevent second edge guide portion 72 from pivoting around axis of rotation 64 when movable media support 56 is moved in pivot direction 95*a* toward stowed position 62, shown in FIG. 4. Pivoting movable media support 56 in pivot direction 95*b* returns movable media support 56 to the operating position 60 shown in FIG. 2.

Figure 5:
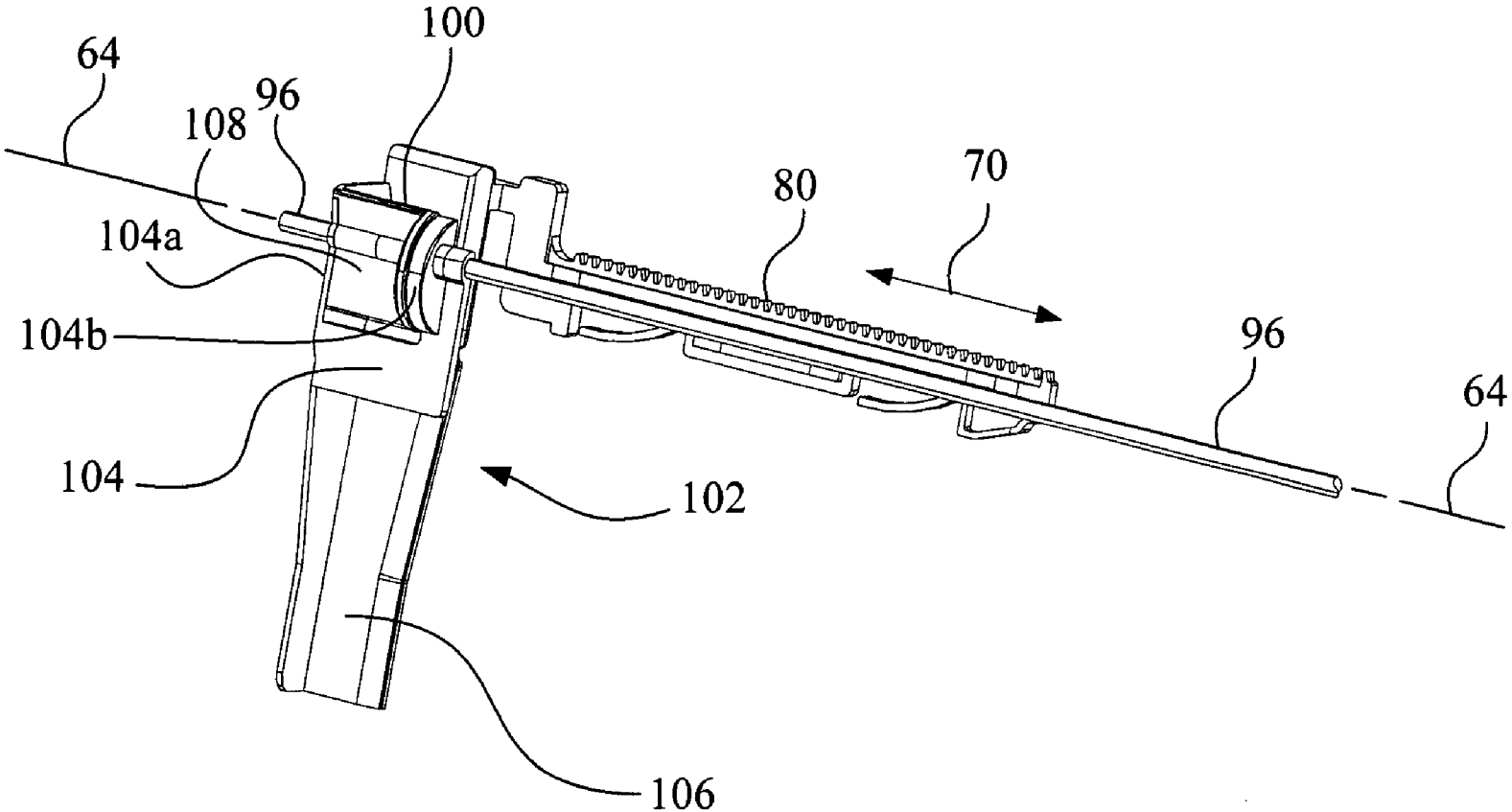
FIG. 5 is a perspective view of another embodiment of the folding media edge guide of the present invention.

In an alternative embodiment, shown in FIG. 5, a first edge guide portion 100 is not connected to a second edge guide portion 102 as in the previous embodiment. Rather, a rod 96 defines axis of rotation 64, and permits first edge guide portion 100 to pivot with movable media support 56 in relation to stationary media support 58 and second edge guide portion 102. Like the previous embodiment, however, first edge guide portion 100 and second edge guide portion 102 are laterally interconnected to move as a unit in lateral direction 70 along axis of rotation 64 to adjust to a width of the supply of print media. In addition, first edge guide portion 100 and second edge guide portion 102 are configured to be rotationally disconnected with respect to axis of rotation 64 to permit first edge guide portion 100 to rotate around axis of rotation 64 in conjunction with movable media support 56 independent of second edge guide portion 102.

In the exemplary embodiment shown, second edge guide portion 102 includes a substantially U-shaped member 104 and an elongate member 106 extending from U-shaped member 104. U-shaped member 104 is defined by a first arm 104*a* and a second arm 104*b*, wherein second arm 104*b* is spaced apart from first arm 104*a*. First edge guide portion 100 includes a body 108 received in U-shaped member 104 between first arm 104*a* and second arm 104*b*. Rod 96, and in turn axis of rotation 64, passes through first arm 104*a* of second edge guide portion 102, body 108 of first edge guide portion 100, and second arm 104*b* of second edge guide portion 102.

While this invention has been described with respect to embodiments of the invention, the present invention may be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A media edge guide assembly for use in an imaging apparatus having a media supply source that includes a base having a stationary media support, and a movable media support pivotably connected to said base to pivot around an axis of rotation, comprising:

a first edge guide portion; and a second edge guide portion, said first edge guide portion and said second edge guide portion being arranged to have said axis of rotation pass through said first edge guide portion and said second edge guide portion, said second edge guide portion being pivotably connected to said first edge guide portion at said axis of rotation, said first edge guide portion and said second edge guide portion being laterally interconnected to facilitate movement as a unit in a lateral direction along said axis of rotation relative to said stationary media support and said movable media support, and said first edge guide portion and said second edge guide portion being configured to permit said first edge guide portion to rotate around said axis of rotation independent of said second edge guide portion and such that said first edge guide portion is not mounted to said second edge guide portion so as to be not rotationally connected to the other.

2. The media edge guide assembly of claim 1, wherein:

said second edge guide portion includes a substantially U-shaped member and an elongate member extending from said U-shaped member, said U-shaped member being defined by a first arm and a second arm, said second arm being spaced apart from said first arm; and said first edge guide portion includes a body, said body being received in said U-shaped member between said first arm and said second arm.

3. The media edge guide assembly of claim 2, wherein said axis of rotation passes through said first arm of said second edge guide portion, said body of said first edge guide portion, and said second arm of said second edge guide portion.

4. The media edge guide assembly of claim 1, further comprising a rod arranged along said axis of rotation, said rod passing through said first edge guide portion and said second edge guide portion.

5. A media edge guide assembly for use in an imaging apparatus having a media supply source, wherein said media supply source includes a base having a stationary media support, and a movable media support pivotably connected to said base to pivot around an axis of rotation, comprising:

a first edge guide portion, wherein said first edge guide portion is mounted to said movable media support; and a second edge guide portion, said first edge guide portion and said second edge guide portion being arranged to have said axis of rotation pass through said first edge guide portion and said second edge guide portion, said second edge guide portion being pivotably connected to said first edge guide portion at said exit of rotation, said first edge guide portion and said second edge guide portion being laterally interconnected to facilitate movement as a unit in a lateral direction along said axis of rotation relative to said movable media support, and said first edge guide portion and said second edge guide portion and said second edge portion being configured to be rotationally disconnected with respect to said axis of rotation to permit said first edge guide portion to rotate around said axis of rotation independent of said second edge guide portion.

6. The media edge guide assembly of claim 5, further comprising a pivot mechanism pivotably connecting said second edge guide portion to said first edge guide portion.

7. The media edge guide assembly of claim 6, wherein said pivot mechanism is positioned such that said first edge guide portion pivots in relation to said second edge guide portion around said axis of rotation.

8. The media edge guide assembly of claim 5, wherein said second edge guide portion extends from said first edge guide portion into said stationary media support.

9. The media edge guide assembly of claim 8, wherein said stationary media support provides a stop to prevent said second edge guide portion from pivoting around said axis of rotation when said movable media support is moved toward a stowed position.

10. An imaging apparatus including a media supply source for feeding a sheet of media in a media feed direction, comprising:

a base including a stationary media support;

a movable media support pivotably connected to said base to pivot around an axis of rotation, said axis of rotation being substantially orthogonal to said media feed direction, said movable media support having a stowed position and an operating position, wherein when said movable media support is in said operating position, said stationary media support and said movable media support cooperate to hold a supply of print media;

a first edge guide portion mounted to said movable media support, said first edge guide portion being movable in a lateral direction along said axis of rotation; and a second edge guide portion operating as an extension of said first edge guide portion, said second edge guide portion being pivotably connected to said first edge guide portion at said axis of rotation, said first edge guide portion and said second edge guide portion being laterally interconnected to move as a unit in said lateral direction along said axis of rotation relative to said stationary media support and said movable media support to adjust to a width of said supply of print media, and said first edge guide portion and said second edge guide portion being configured to be rotationally disconnected with respect to said axis of rotation to permit said first edge guide portion to rotate around said axis of rotation in conjunction with said movable media support independent of said second edge guide portion.

11. The imaging apparatus of claim 10, wherein:

said second edge guide portion includes a substantially U-shaped member and an elongate member extending from said U-shaped member, said U-shaped member being defined by a first arm and a second arm, said second arm being spaced apart from said first arm; and said first edge guide portion includes a body received in said U-shaped member between said first arm and said second arm.

12. The imaging apparatus of claim 11, wherein said axis of rotation passes through said first arm of said second edge guide portion, said body of said first edge guide portion, and said second arm of said second edge guide portion.

13. The imaging apparatus of claim 11, wherein said elongate member of said second edge guide portion engages said stationary media support of said base without connection thereto.

14. The imaging apparatus of claim 10, further comprising a pivot mechanism pivotably connecting said second edge guide portion to said first edge guide portion.

15. The imaging apparatus of claim 14, wherein said pivot mechanism is positioned such that said first edge guide portion pivots in relation to said second edge guide portion around said axis of rotation.

16. The imaging apparatus of claim 15, wherein said stationary media support provides a stop to prevent said second edge guide portion from pivoting around said axis of rotation when said movable media support is moved toward said stowed position.

17. The imaging apparatus of claim 10, wherein said first edge guide portion and said second edge guide portion combine to form a first edge guide, and further comprising:

a second edge guide laterally spaced apart from said first edge guide along said axis of rotation; and a rack gear system coupling said first edge guide to said second edge guide, said rack gear system being configured such that said first edge guide and said second edge guide move in unison in a lateral direction along said axis of rotation, but in opposite directions.

18. The imaging apparatus of claim 10, further comprising a rod arranged along said axis of rotation, said rod passing through said first edge guide portion and said second edge guide portion.

19. A media edge guide assembly for use in an imaging apparatus having a media supply source that includes a base having a stationary media support, and a movable media support pivotably connected to said base to pivot around an axis of rotation, comprising:

a first edge guide portion mounted to said movable media support and configured to pivot around said axis of rotation with said movable media support; and a second edge guide portion pivotably connected to said first edge guide portion at said axis of rotation, said second edge guide portion being thereby configured to allow said first edge guide portion to pivot around said axis of rotation independent of said second edge guide portion, said first edge guide portion and said second edge guide portion being laterally interconnected to facilitate movement as a unit in a lateral direction along said axis of rotation relative to said stationary media support and said movable media support.

* * * * *